US007524221B2

(12) United States Patent
Hikosaka

(10) Patent No.: US 7,524,221 B2
(45) Date of Patent: Apr. 28, 2009

(54) SHIFT MECHANISM OF OUTBOARD MOTOR

(75) Inventor: Tomokazu Hikosaka, Shizuoka-Ken (JP)

(73) Assignee: Suzuki Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 11/927,190

(22) Filed: Oct. 29, 2007

(65) Prior Publication Data

US 2008/0102718 A1 May 1, 2008

(30) Foreign Application Priority Data

Oct. 31, 2006 (JP) ..... 2006-295398

(51) Int. Cl.
*B63H 23/00* (2006.01)

(52) U.S. Cl. ..... 440/75; 440/86

(58) Field of Classification Search ..... 440/75, 440/86

See application file for complete search history.

(56) References Cited

U.S. PATENT DOCUMENTS 4,525,149 A * 6/1985 Broughton et al. ..... 440/1
4,747,795 A * 5/1988 Kawamura et al. ..... 440/75

FOREIGN PATENT DOCUMENTS

JP 11-141356 A 5/1999
JP 2004-351947 A 12/2004

* cited by examiner

*Primary Examiner*—Stephen Avila
(74) *Attorney, Agent, or Firm*—Barnes & Thornburg LLP

(57) ABSTRACT

An outboard motor includes an engine vertically supporting a crankshaft above an engine holder and a shift mechanism switching a rotational direction of a propeller shaft by actuating a shift apparatus through a remote control from a shift lever. The shift mechanism includes a first link mechanism connecting a shift cable extending from the shift lever and a clutch rod extending toward a shift rod, the first link mechanism being disposed in a space formed between a lower surface of the engine and an upper surface of the engine holder and also includes a second link mechanism connecting the clutch rod and the shift rod and disposed in a space between a drive shaft housing and a gear case of the outboard motor.

5 Claims, 6 Drawing Sheets

SHIFT MECHANISM OF OUTBOARD MOTOR

This application is based upon and claims the benefit of priority under 35 U.S.C. § 119 from the prior Japanese Patent Application No. 2006-295398, filed Oct. 31, 2006, the contents of which is incorporated herein by reference.

BACKGROUND OF THE INVENTION

1. Field of the Invention

The present invention relates to a shift mechanism of an outboard motor.

2. Related Art

An outboard motor is provided with a shift apparatus for switching a propeller shaft between forward/reverse rotations and a neutral state by a remote control. The switching is generally performed by moving forward and backward a push rod provided in the propeller shaft by a shift apparatus arranged in a gear case so as to connect or disconnect a clutch dog to or from the propeller shaft, which may be called a shift-in and shift-out method.

The shift operation for actuating the shift apparatus is achieved by taking in a motion, for example, of a shift lever operated by an operator into the outboard motor via a shift cable so as to transmit to the shift apparatus within the gear case via a shift link mechanism through a clutch rod. The clutch rod extends from an upper portion of the outboard motor to the gear case in a lower side while passing through a pilot shaft generally supporting the outboard motor so as to be steered right and left (for example, refer to Japanese Patent Laid-Open Publication Nos. 11-141356 and 2004-351947).

However, since an outboard motor body supporting a clutch rod is elastically mounted to a hull via a mount while the pilot shaft is rigidly attached to the hull via a clamp bracket, the clutch rod is moved within the pilot shaft when the mount apparatus is displaced. Accordingly, in order to prevent the pilot shaft from being interfered with the clutch rod, it is necessary to enlarge an inner diameter of the pilot shaft more than necessary, which results in the increasing of the weight of the entire structure.

On the other hand, since a part of a sliding portion of the shift link mechanism is not positively lubricated, there is a risk of lowering operability.

SUMMARY OF THE INVENTION

The present invention was conceived in consideration of the circumstances encountered in the prior art mentioned above, and an object of the present invention is to provide a shift mechanism of an outboard motor which intends to achieve weight saving and to improve an operability.

This and other objects can be achieved according to the present invention by providing a shift mechanism of an outboard motor, in which an engine vertically supporting a crankshaft is disposed above an engine holder, and a propeller shaft is switched in a rotational direction by actuating a shift apparatus through a remote control from a shift lever, wherein a first link mechanism connecting a shift cable extending from the shift lever and a clutch rod extending toward a shift rod actuating the shift apparatus is provided in a space formed between a lower surface of the engine and an upper surface of the engine holder.

In a preferred embodiment, it may be desired that the clutch rod is inserted to a drive shaft housing on a rear side of a pilot shaft supporting the outboard motor to be steered right and left. A second link mechanism connecting the clutch rod and the shift rod may be further arranged in a space formed between a lower surface of the drive shaft housing and an upper surface of a gear case provided below the drive shaft housing.

It may be further desired that a drive shaft is disposed to be offset to a rear side of the crankshaft, the crankshaft and the drive shaft are connected via a reduction gear, and the first link mechanism is arranged in a space formed on a lower side of the crankshaft.

Furthermore, in a preferred aspect, there is provided a shift mechanism of an outboard motor, in which an engine vertically supporting a crankshaft is disposed above an engine holder and a propeller shaft is switched in a rotational direction, the shift mechanism comprising:

a clutch rod operatively connected to the propeller shaft;

a shift rod operatively connected to the clutch rod;

a shift cable operatively connected to the clutch rod through a clutch lever;

a first link mechanism connecting the shift cable extending from a shift lever and the clutch rod extending toward the shift rod and disposed in a space between a drive shaft housing and a gear case of the outboard motor; and a second link mechanism connecting the clutch rod and the shift rod and disposed in a space between a drive shaft housing and a gear case of the outboard motor.

According to the shift mechanism of the outboard motor of the present invention, operability and an operation feeling of the shift mechanism are improved, and a complicated maintenance working is eliminated. In addition, it is possible to provide a compact and lightweight structure of the pilot shaft.

Furthermore, it is possible to use a conventional gear case, as it is, and it is also possible to effectively utilize a dead space and achieve a compact structure of the outboard motor.

The nature and further characteristic features of the present invention will be made clearer from the following descriptions made with reference to the accompanying drawings.

DESCRIPTION OF THE PREFERRED EMBODIMENT

One preferred embodiment of a shift mechanism of an outboard motor according to the present invention will be described hereunder with reference to the accompanying drawings. Further, it is to be noted that terms "upper", "lower", "right", "left" and like terms are used herein with reference to the illustrations of the drawings or in an actual usable state of the outboard motor.

Figure 1:
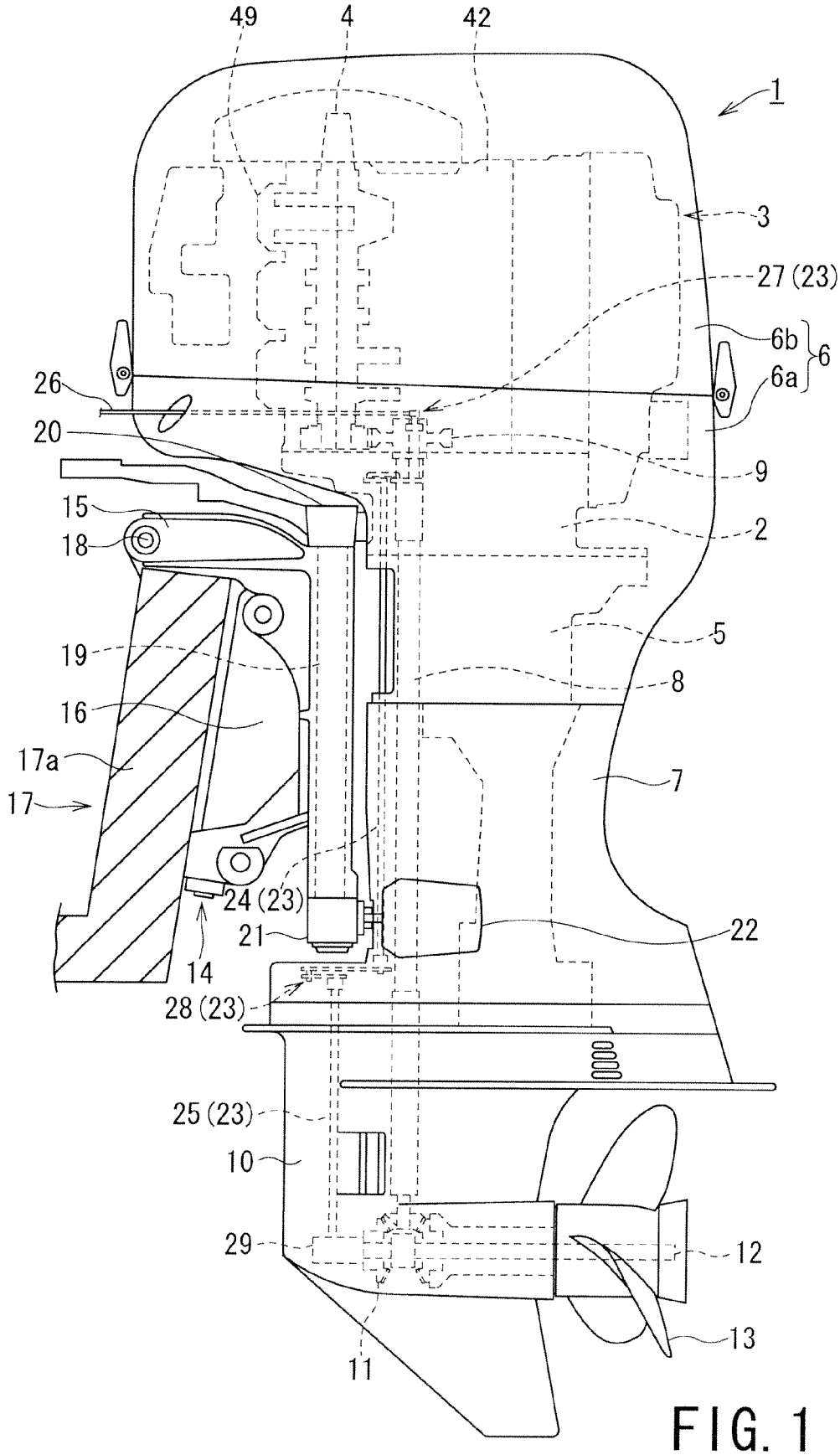
FIG. 1 is a left side view of an outboard motor representing an embodiment of a shift mechanism of an outboard motor according to the present invention.
Figure 2:
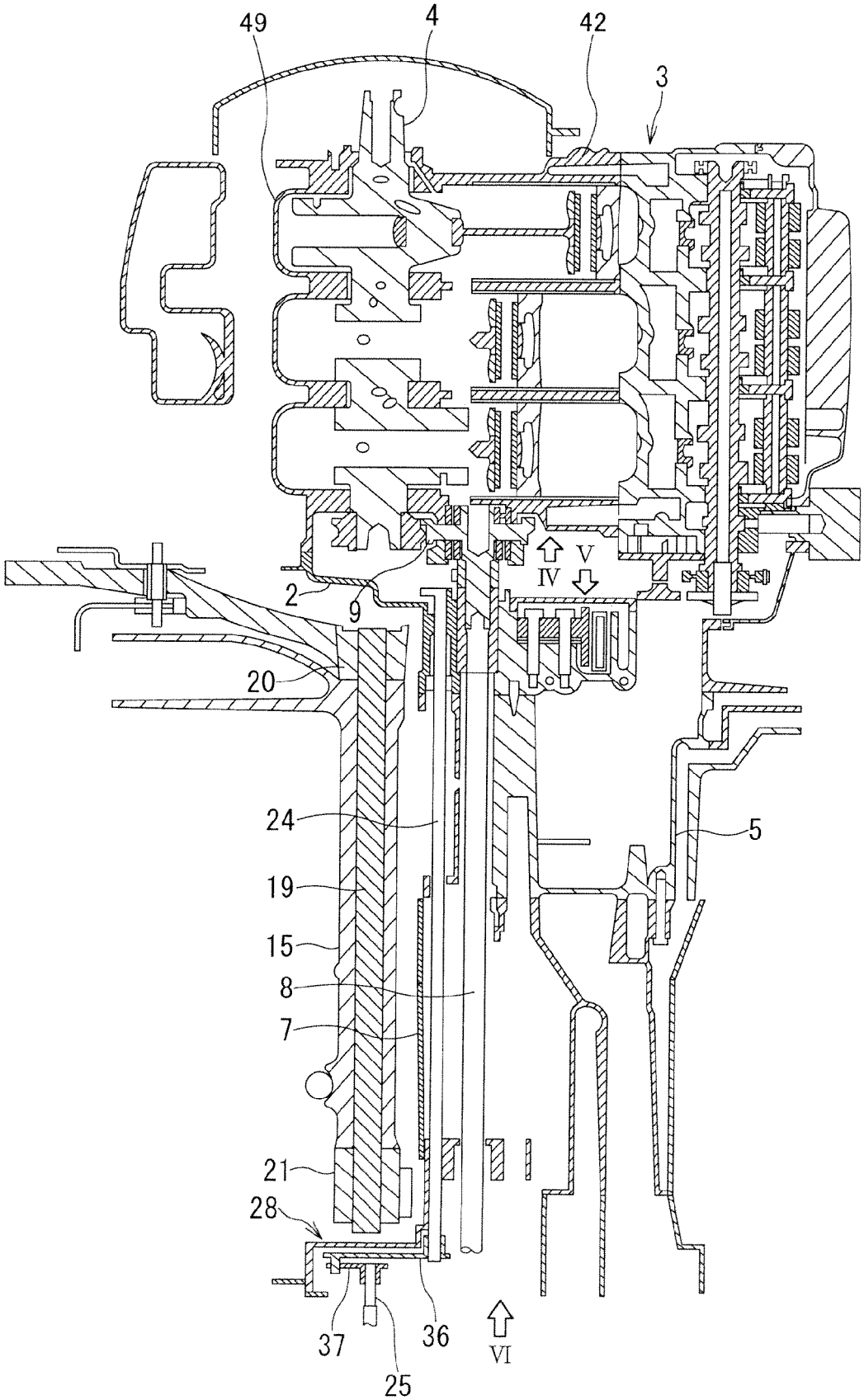
FIG. 2 is a vertical cross sectional view of an essential portion of the outboard motor.
Figure 3:
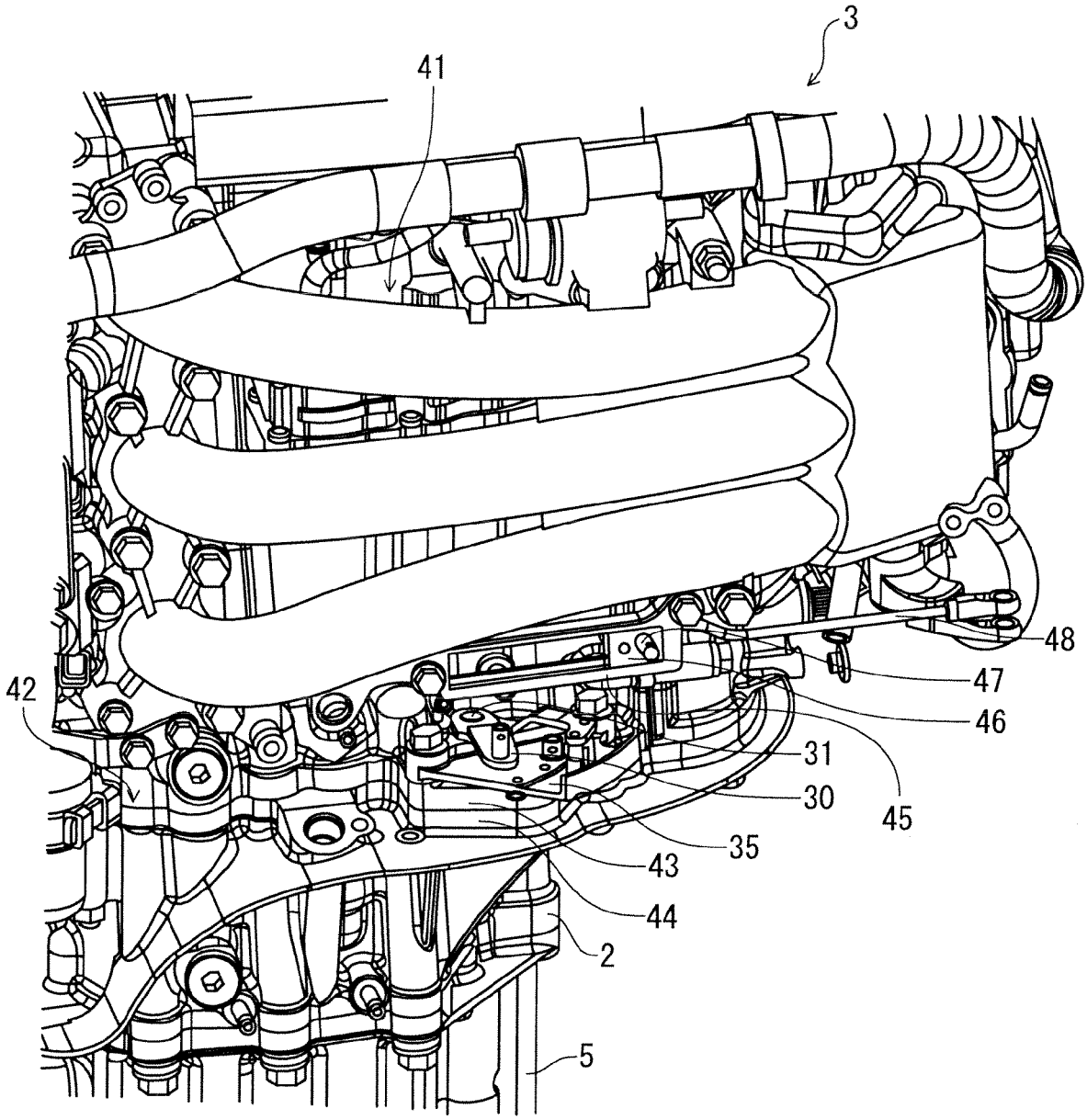
FIG. 3 is a right side view of an engine of the outboard motor.
Figure 4:
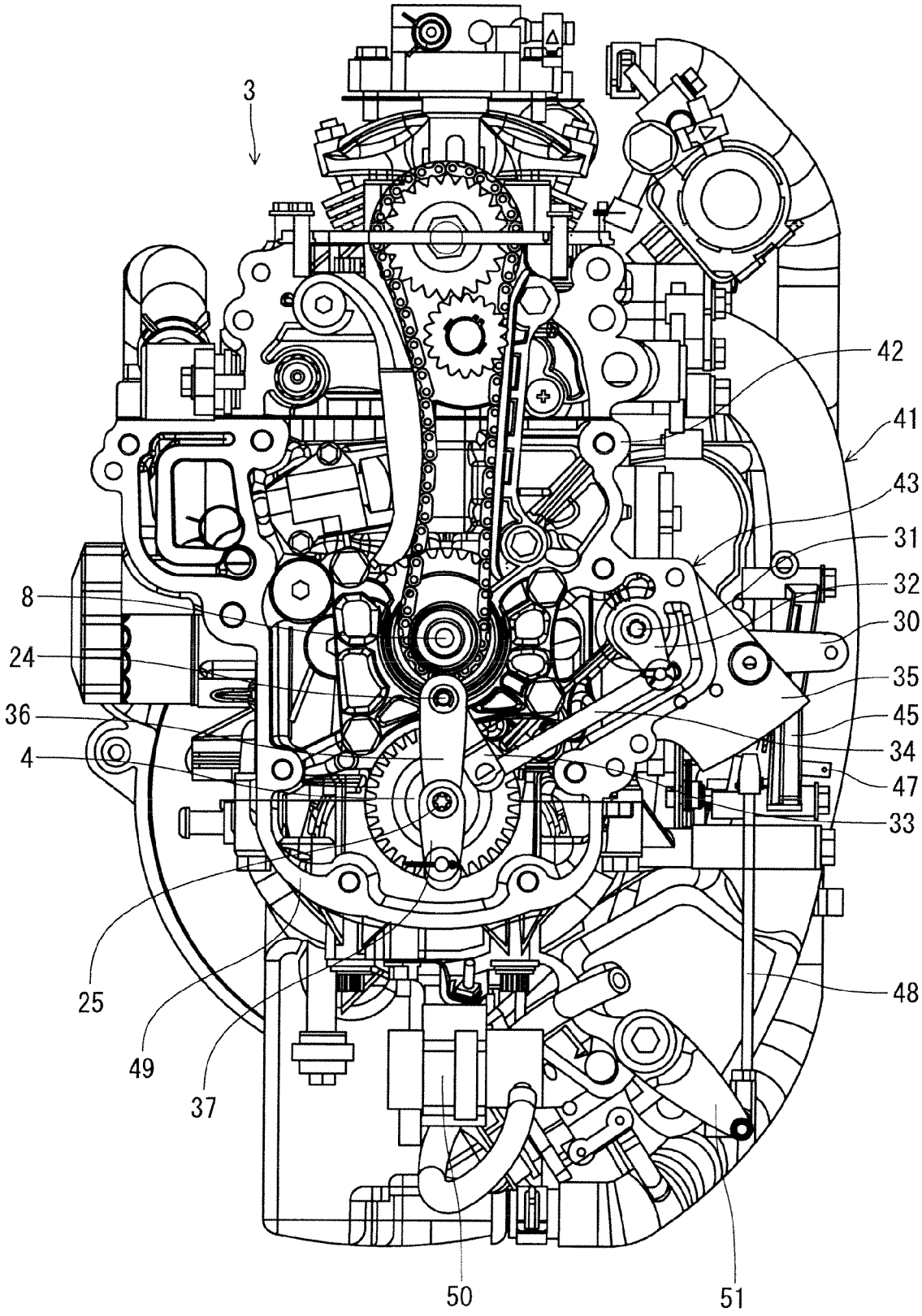
FIG. 4 is a view as seen from an arrow IV in FIG. 2.
Figure 5:
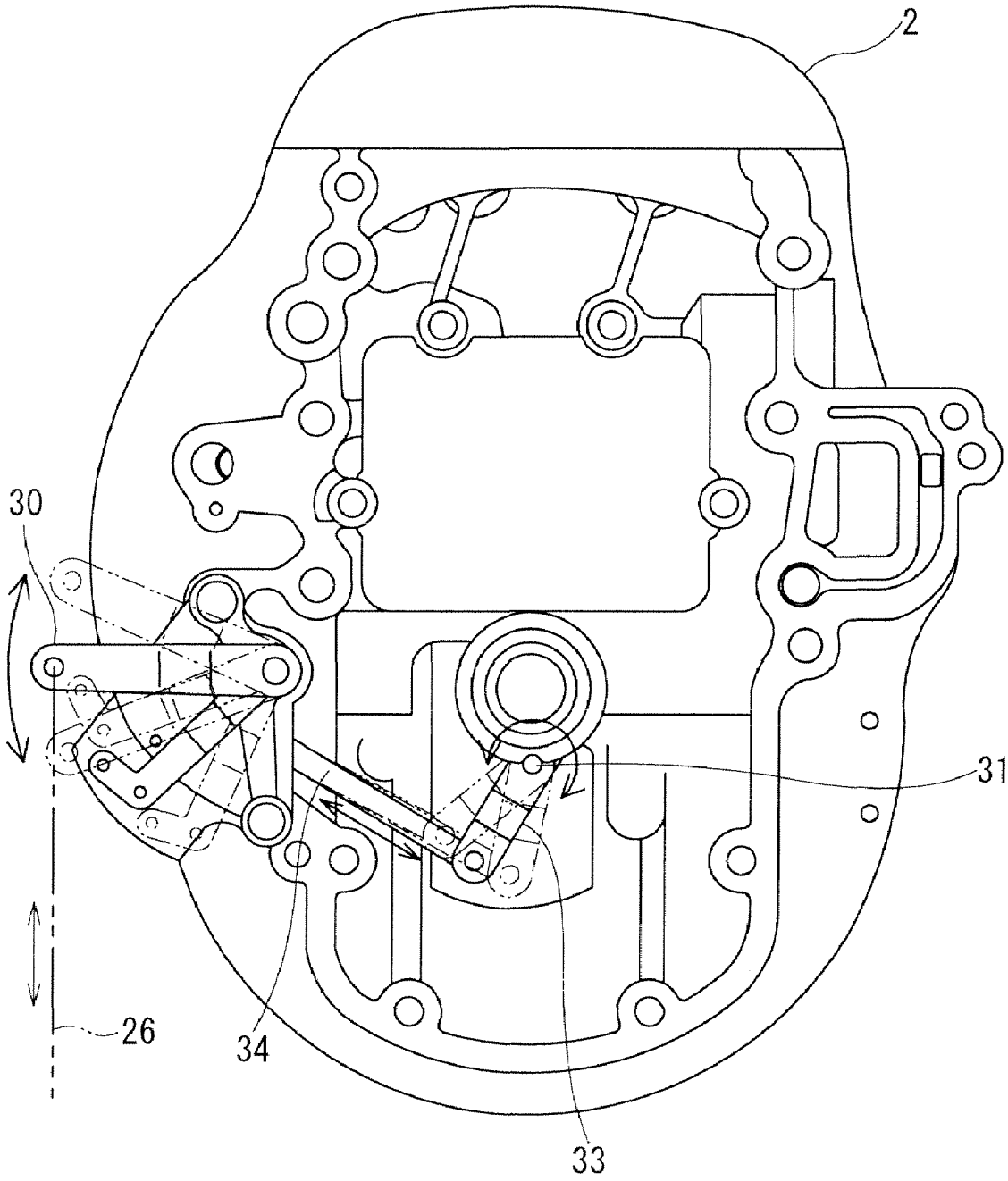
FIG. 5 is a view as seen from an arrow V in FIG. 2.
Figure 6:
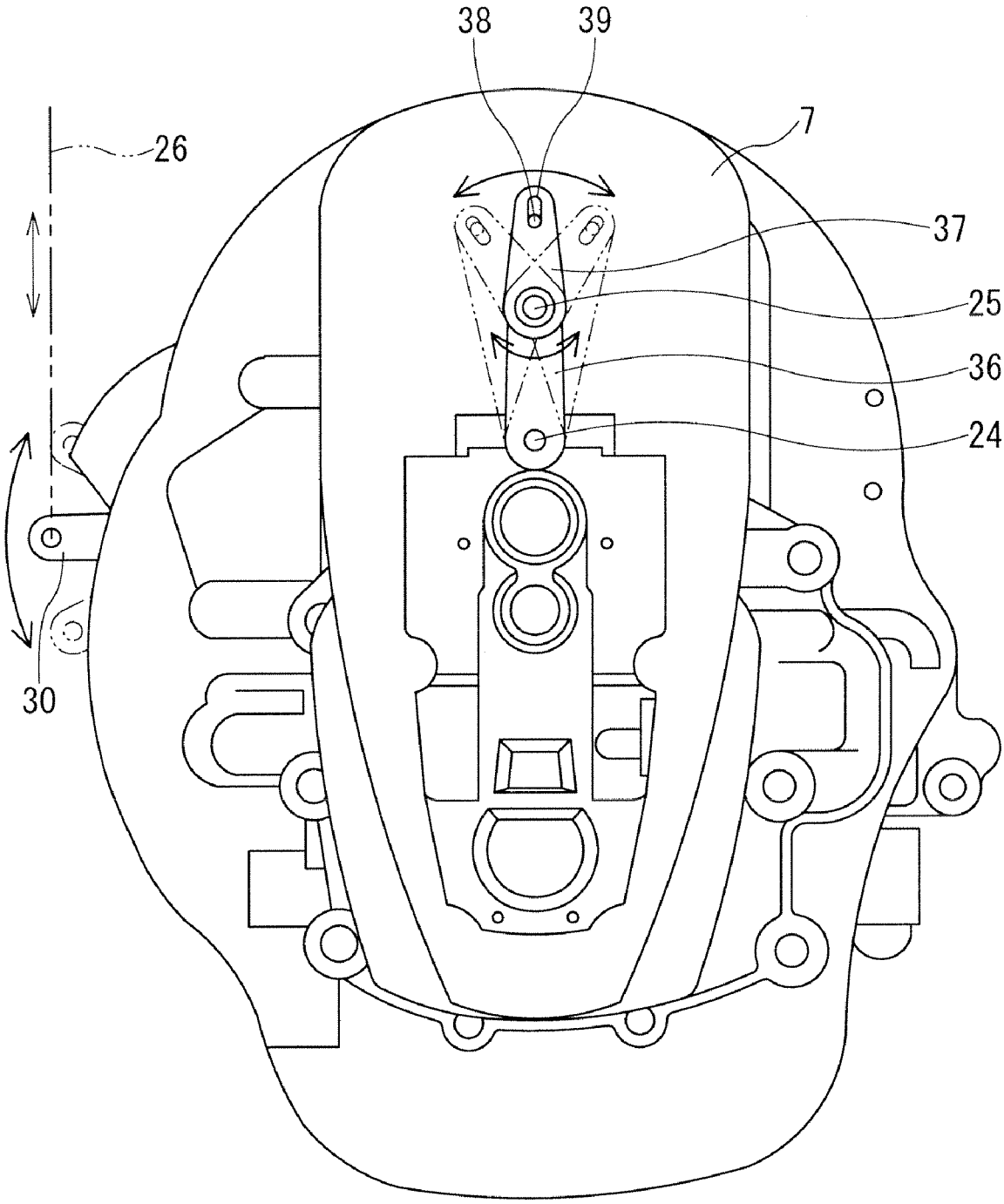
FIG. 6 is a view as seen from an arrow VI in FIG. 2.

With reference to FIGS. 1 and 2, an outboard motor 1 includes an engine holder 2 and a four-stroke engine 3 mounted on the engine holder 2. The engine 3 is a vertical-type engine 3 in which a crankshaft 4 is approximately vertically supported inside the engine 3.

An oil pan 5 reserving lubricating oil, not shown, is arranged on a lower side of the engine holder 2. A periphery of the engine holder 2, the engine 3 and the oil pan 5 are covered by an engine cover 6. The engine cover 6 has a structure to be dividable into two sections including a lower cover section 6*a* covering the periphery of the engine holder 2, a lower portion of the engine 3 and the oil pan 5, and an upper cover 6*b* section covering an upper portion of the engine 3.

Further, a drive shaft housing 7 is installed to a lower portion of the oil pan 5. A drive shaft 8 corresponding to an output shaft of the engine 3 is approximately vertically arranged within the engine holder 2 so as to extend through the oil pan 5 and the drive shaft housing 7. The drive shaft 8 is offset to a rear side of the crankshaft 4, and an upper end portion of the drive shaft 8 is connected to a lower end portion of the crankshaft 4 via a reduction gear 9. The drive shaft 8 downward extends in the drive shaft housing 7 and serves to drive a propeller shaft 13 as a propulsion apparatus via a bevel gear 11 and a propeller shaft 12 arranged in the gear case 10 provided in the lower portion of the drive shaft housing 7.

The outboard motor 1 includes a bracket unit 14. The bracket unit 14 includes a swivel bracket 15 and a clamp bracket 16. The swivel bracket 15 is fixed to the outboard motor 1, and the clamp bracket 16 is fixed to a transom 17*a* of a hull 17, respectively.

The swivel bracket 15 is pivoted to the clamp bracket 16 so as to be swingable around a tilt shaft 18, and a pilot shaft 19 is vertically pivoted to the swivel bracket 15 so as to be rotatable. Further, an upper mount bracket 20 and a lower mount bracket 21 are respectively provided at upper and lower ends of the pilot shaft 19 so as to be integrally rotated.

On the other hand, a pair of upper mount units, which are not illustrated in detail, are provided in a front portion of the engine holder 2, and are connected to the upper mount bracket 20. Further, a pair of lower mount units 22 are provided in both side portions of the drive shaft housing 7 and connected to the lower mount bracket 21. Thus, the outboard motor 1 can be steered right and left around the pilot shaft 19 with respect to the bracket unit 14 so as to be tilted and trimmed around the tilt shaft 18.

Herein, with reference to FIGS. 1 to 6, the outboard motor 1 of the structure mentioned above further includes a shift mechanism 23 for switching the propeller shaft 12 between forward/reverse rotation and a neutral state by remote control.

The shift mechanism 23 mainly includes a clutch rod 24, a shift rod 25, a plurality of link mechanisms connecting the rods 24 and 25. A shift cable 26 shown in FIG. 1 extending toward the outboard motor 1 from, for example, a shift lever, not shown, provided on the hull 17 side and operated by an operator is connected to an upper end portion of the clutch rod 24 via a first link mechanism 27 within the outboard motor 1.

The clutch rod 24 extends toward the gear case 10 in the drive shaft housing 7 on the rear side of the pilot shaft 19 and on the front side of the drive shaft 8. A lower end portion of the clutch rod 24 is connected to an upper end portion of the shift rod 25 via a second link mechanism 28 near a joint portion between the drive shaft housing 7 and the gear case 10.

The motion in a longitudinal direction of the shift lever operated by the operator is converted into a rotational force so as to be transmitted to the shift rod 25. Thus, the push rod, not shown, is moved forward and backward via a shift apparatus 29 provided at a front end portion of the propeller shaft 12 so that a clutch dog, not shown, is connected or disconnected to or from the propeller shaft 12.

The first link mechanism 27 includes a clutch lever 30, a clutch shaft 31, a clutch shaft arm 32, a clutch rod arm 33 and an upper clutch link 34, and is arranged in a space formed between a lower surface of the engine 3 and an upper surface of the engine holder 2, that is, a lower space of the crankshaft 4 in which the drive shaft 8 is offset to a rear side in the present embodiment.

Further, an intake manifold 41 constituting an intake system is arranged in one side portion of the engine 3, and a protruding portion 43 (i.e., bulge portion) is provided on a lower side portion of a cylinder block 42 forming the engine 3, below the intake manifold 41. A link holder 35 supporting the first link mechanism 27 is fixed to an upper surface of the protruding portion 43.

A base end portion of the clutch lever 30 is pivoted to the link holder 35 so as to be rotatable in a horizontal direction via the clutch shaft 31 and to be rotatable integrally with the clutch shaft 31. The shift cable 26 is connected to a free end portion of the clutch lever 30 protruding to an outer side in a width direction of the engine 3. Further, a base end portion of the clutch shaft arm 32 is pivoted to the clutch shaft 31 so as to be rotatable integrally with the clutch shaft 31.

A base end portion of the clutch rod arm 33 is pivoted to an upper end portion of the clutch rod 24 so as to be rotatable integrally with the clutch rod 24. A free end portion of the clutch shaft 32 and a free end portion of the clutch rod arm 33 are connected through the upper clutch link 34. In other words, if the shift cable 26 is operated, the clutch lever 30 rotates the clutch shaft 31, and rotational motion of the clutch shaft 31 then rotates the clutch rod 24 via the clutch shaft arm 32, the upper clutch link 34 and the clutch rod arm 33 (refer to FIG. 5).

In this case, a protruding portion 44 having the same shape as that of the protruding portion 43 of the cylinder block 42 is formed on the engine holder 2 side. A portion of the clutch shaft arm 32 and the upper clutch link 34 is arranged in a space defined between both the protruding portions 43 and 44, and the remaining portions of the upper clutch link 34 and the clutch rod arm 33 are arranged in a lower side space of the crankshaft 4. Further, a neutral switch, not shown, for detecting the fact that the shift position is the neutral state, is attached to the link holder 35.

On the other hand, the second link mechanism 28 includes a lower clutch link 36 and a shift rod arm 37, and is arranged in a space formed between a lower surface of the drive shaft housing 7 and an upper surface of the gear case 10.

A base end portion of the lower clutch link 36 is pivoted to a lower end portion of the clutch rod 24 so as to be rotatable integrally with the clutch rod 24. A free end portion of the lower clutch link 36 extends forward, and an engagement pin 38 protrudes downward from a leading end portion thereof.

Further, a base end portion of the shift rod arm 37 is pivoted to an upper end portion of the shift rod 25 extending upward from the shift apparatus 29 in the front side of the propeller shaft 12 so as to be rotatable integrally with the shift rod 25. A free end portion of the shift rod arm 37 extends forward, and the engagement pin 38 of the lower clutch link 36 is engaged with a long hole 39 formed in the leading end portion of the shift rod arm 37. In other words, if the clutch rod 24 is rotated, the rotational motion serves to rotate the shift rod 25 via the lower clutch link 36 and the shift rod arm 37 as seen from FIG. 6.

A throttle holder 45 is arranged below the intake manifold 41 and above the link holder 35 on the side portion of the cylinder block 42. A slider 46 is held to the throttle holder 45 so as to be slidable in a longitudinal direction, and a pivot 47 is formed so as to protrude in a lateral direction.

One end of the link rod 48 is connected to an inner pivot, not shown, of the slider 46, and the other end of the link rod 48 is connected to a throttle lever 51 attached to a throttle body 50 arranged in front of a crankcase 49 constructing the engine 3. Further, a throttle cable, not shown, is connected to the outer pivot 47 of the slider 46.

Next, the operation and functions of the shift mechanism of the outboard motor of the embodiment mentioned above will be described hereunder.

The first link mechanism 27 connecting the shift cable 26 extending from the shift lever and the clutch rod 24 extending toward the shift rod 25 for actuating the shift apparatus 29 is provided in the space formed between the lower surface of the engine 3 and the upper surface of the engine holder 2. Accordingly, the first link mechanism 27 can be arranged in the inner portion of the engine 3, and it is hence possible to prevent the first link mechanism 27 from being wetted by seawater. As a result, rust and adhesion of salt are prevented, thereby improving the accuracy of the sliding portion and an operation feeling.

The oil lubricating the engine 3 also lubricates the sliding portion of the first link mechanism 27. Therefore, the operability and the operation feeling of the engine can be improved, thus eliminating the maintenance working.

Since the clutch rod 24 is inserted into the drive shaft housing 7 in the rear side of the pilot shaft 19, it is possible to prevent a malfunction caused by a damage of the clutch rod 24 due to an external force, a winding of a fishing line or the like, and the clutch rod 24 is hard to be wetted by sea water in the same manner as the first link mechanism 27. Accordingly, rust and adhesion of salt are prevented, thereby improving the durability thereof.

In a conventional art, the clutch rod 24 is inserted into the pilot shaft 19, the inner diameter of the pilot shaft 19 is enlarged more than necessary for the purpose of preventing the internal interference. However, in the present invention, since the clutch rod 24 is not inserted into the pilot shaft 19, the diameter of the pilot shaft 19 can be reduced, and the compact and lightweight structure can be achieved.

In this case, if the clutch rod 24 is displaced to a rear side from the conventionally arranged position, a displacement is generated between the clutch rod 24 and the shift apparatus 29 provided in the front end portion of the propeller shaft 12. However, since the second link mechanism 28 connecting the clutch rod 24 and the shift rod 25 is provided between the clutch rod 24 and the shift rod 25 extending upward from the shift apparatus 29 near the joint portion between the drive shaft housing 7 and the gear case 10, the conventional gear case 10 can be used as it is, and design freedom is enhanced.

Further, effective utilization of the dead space and compact structure of the outboard motor 1 can be achieved by arranging and connecting the drive shaft 8 so as to be offset to the rear side of the crankshaft 4 via the reduction gear 9 and arranging the first link mechanism 27 in the lower space of the crankshaft 4.

What is claimed is:

1. A shift mechanism of an outboard motor, in which an engine vertically supporting a crankshaft is disposed above an engine holder and a propeller shaft is switched in a rotational direction by actuating a shift apparatus through a remote control from a shift lever, wherein a first link mechanism connecting a shift cable extending from the shift lever and a clutch rod extending toward a shift rod actuating the shift apparatus is provided inside a first space formed by joining a lower surface of the engine and an upper surface of the engine holder, a lower end of the crankshaft and an upper end of the drive shaft are coupled with each other via a reduction gear, the drive shaft is disposed to be offset to a rear side of the crankshaft, and the first link mechanism is arranged in a space below the reduction gear on a lower side of the crankshaft.

2. The shift mechanism of an outboard motor according to claim 1, wherein the clutch rod is inserted through a drive shaft housing on a rear side of a pilot shaft supporting the outboard motor to be steered right and left and is coupled with the shift rod arranged forward of the clutch rod through the second link mechanism.

3. The shift mechanism of an outboard motor according to claim 2, wherein a second link mechanism connecting the clutch rod and the shift rod is arranged inside a second space formed by joining a lower surface of the drive shaft housing and an upper surface of a gear case provided below the drive shaft housing.

4. A shift mechanism of an outboard motor, in which an engine vertically supporting a crankshaft is disposed above an engine holder and a propeller shaft is switched in a rotational direction, the shifting mechanism comprising:

a clutch rod operatively connected to the propeller shaft;

a shift rod operatively connected to the clutch rod;

a shift cable operatively connected to the clutch rod through a clutch lever;

a first link mechanism connecting the shift cable extending from a shift lever and the clutch rod extending toward the shift rod and disposed inside a first space formed by joining a lower surface of the engine and an upper surface of the engine holder; and a second link mechanism connecting the clutch rod and the shift rod and arranged in a second space formed by joining a lower surface of the drive shaft housing and an upper surface of a gear case provided below the drive shaft housing, wherein the clutch rod is inserted through a drive shaft housing on a rear side of a pilot shaft and is coupled with the shift rod arranged forward of the clutch rod through the second link mechanism, and wherein a lower end of the crankshaft and an upper end of the drive shaft are coupled with each other via a reduction gear.

5. The shift mechanism of an outboard motor according to claim 1, wherein the first link mechanism has a structure in which the clutch rod is rotated around an axis thereof.

* * * * *